US006866155B2

(12) United States Patent
Nagel

(10) Patent No.: US 6,866,155 B2
(45) Date of Patent: Mar. 15, 2005

(54) PRODUCT DISPLAY RACK

(75) Inventor: Thomas O. Nagel, Blairstown, NJ (US)

(73) Assignee: Trion Industries, Inc., Wilkes-Barre, PA (US)

( * ) Notice: Subject to any disclaimer, the term of this patent is extended or adjusted under 35 U.S.C. 154(b) by 87 days.

(21) Appl. No.: 10/323,461

(22) Filed: Dec. 18, 2002

(65) Prior Publication Data

US 2004/0065631 A1 Apr. 8, 2004

Related U.S. Application Data

(63) Continuation-in-part of application No. 10/219,800, filed on Aug. 16, 2002, now Pat. No. 6,745,906, which is a continuation-in-part of application No. 10/232,509, filed on Aug. 30, 2002.

(51) Int. Cl.[7] ..... A97F 7/00
(52) U.S. Cl. ..... 211/59.3
(58) Field of Search ..... 211/59.3, 59.2, 211/49.1, 85.31, 133.5

(56) References Cited

U.S. PATENT DOCUMENTS

| | | | | |
|---|---|---|---|---|
| 1,703,987 A | | 3/1929 | Butler | |
| 1,910,046 A | | 5/1933 | Pascoe | |
| 2,079,754 A | | 5/1937 | Waxgiser | |
| 3,110,402 A | * | 11/1963 | Mogulesco | 211/59.3 |
| 3,161,295 A | * | 12/1964 | Chesley | 211/59.3 |
| 3,308,961 A | | 3/1967 | Chesley | |
| 4,130,203 A | | 12/1978 | Russell, III | |
| 4,303,162 A | * | 12/1981 | Suttles | 211/59.3 |
| 4,899,893 A | | 2/1990 | Robertson | |
| 4,901,869 A | * | 2/1990 | Hawkinson et al. | 211/59.3 |
| 5,069,349 A | * | 12/1991 | Wear et al. | 211/59.3 |
| 5,366,099 A | * | 11/1994 | Schmid | 211/59.3 |
| 5,730,320 A | | 3/1998 | David | |
| 5,855,283 A | * | 1/1999 | Johnson | 211/59.3 |
| 6,082,558 A | * | 7/2000 | Battaglia | 211/59.3 |
| 6,142,317 A | * | 11/2000 | Merl | 211/59.3 |
| 6,357,606 B1 | | 3/2002 | Henry | |
| 6,464,089 B1 | * | 10/2002 | Rankin, VI | 211/59.3 |

FOREIGN PATENT DOCUMENTS

GB 1299451 12/1972

* cited by examiner

*Primary Examiner*—Hugh B. Thompson, II
*Assistant Examiner*—Sarah Purol
(74) *Attorney, Agent, or Firm*—Schweitzer Cornman Gross & Bondell LLP

(57) ABSTRACT

A display rack for the display of merchandise packages with provisions for moving product packages toward the front. A pusher sled is formed of front and back plastic wall panels, spaced apart at the bottom, with side opening notches at the edges and downwardly opening notches at the bottom for sliding engagement with and support by a base comprised of four spaced-apart, parallel wire-like supports. The four support wires are disposed in a flat plane and serve as a sliding support for product items placed on the display rack. The four wires also guide, support and retain the pusher sled for easy sliding movement under the urging of one or more coiled strip springs. The springs are confined between the wall panels of the sled and strip portions thereof extend through openings in the, front wall panel to anchor points at the front of assembly. The four support wires are connected at their ends by welded cross bars, which in turn are supported in small plastic base members. The plastic base members have recesses for the laterally adjustable reception of side guides, which enable the width of the display assembly to be varied. A plurality of individual display racks may be joined in a multi-unit display assembly comprising a plurality of display racks arranged side-by-side and in two or more tiers. Connecting frames are provided with upper and lower connecting rods connecting the plastic bases of racks at one or more levels. Customized mock-ups can be quickly and inexpensively prepared for customer testing because the structures require no parts to be custom molded or machined. Exceptional economies are realized in the manufacture of the display assembly while providing a system which aesthetically attractive, with superior performance.

13 Claims, 11 Drawing Sheets

FIG. 6
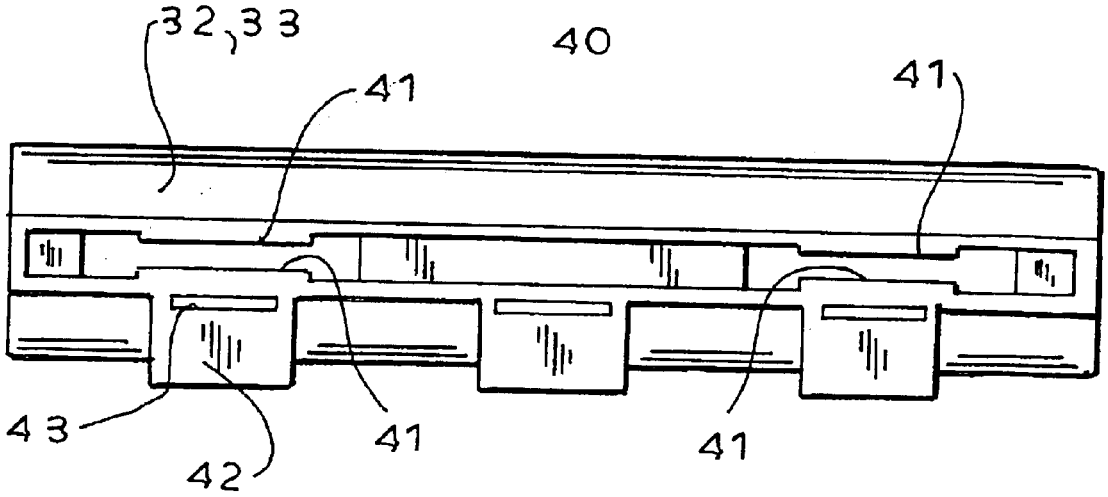
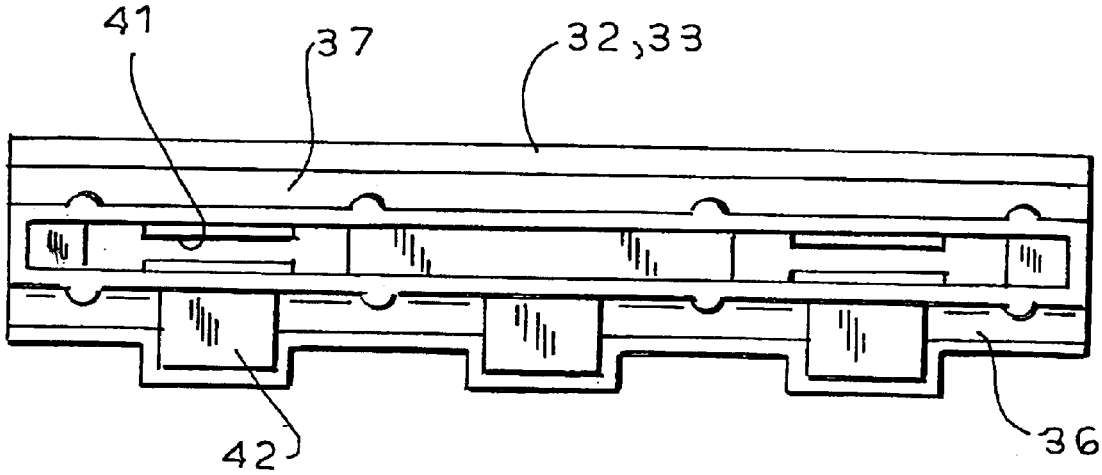
FIG. 7

PRODUCT DISPLAY RACK

RELATED APPLICATIONS

This application is related to co-pending U.S. Ser. No. 10/024,153, filed Dec. 17, 2001, and is a continuation-in-part of applications Ser. No. 10/219,800, filed Aug. 16, 2002, (now U.S. Pat. No. 6,745,906), and Ser. No. 10/232,509, filed Aug. 30, 2002.

BACKGROUND OF THE INVENTION

Product display and shelf management frequently requires, or at least desires, that a supply of products of the same type, displayed on a shelf, display board or the like, be kept in an orderly, upright arrangement and be constantly urged forwardly, as product items are removed, so that the display is always neat and product is always visible and available for display at the front of the display device. A variety of devices and systems have been proposed over the years for accomplishing this objective. Most have had shortcomings either in the form of high cost or inadequate performance or, in many cases, both. In a typical case, display racks have been provided with pusher mechanisms, designed as self-contained units that are installed in the display rack and function as an independent mechanism. In some cases, the entire display rack is specially designed to incorporate an intricate form of pusher mechanism. The present invention provides an integrated display rack and product pusher system that is ultimate in its simplicity, highly reliable in function, easily configurable to accommodate a wide variety of products and display requirements and at the same time capable of being made available at a minimum cost.

SUMMARY OF INVENTION

In accordance with one aspect of the present invention, a novel and improved display rack assembly is provided, which incorporates in a uniquely synergistic combination, an open wire rack structure, which slidably supports a pusher element of inexpensive, preferably extruded construction, comprised primarily of front and back sheet-like panels, joined at the top in the form of an inverted V. The display rack includes a base, comprising preferably four laterally spaced parallel wire support elements, extending from front to back of the display device and rigidly connected at front and back ends thereof. The wire base structure is mounted in a manner to dispose the longitudinal wire elements spaced at least slightly above the surface of a shelf or other display medium on which the display rack is to be presented. This is advantageously accomplished by means of special molded plastic base members, for example of the type disclosed in my co-pending application Ser. No. 10/219,800.

A novel and uniquely simplified pusher arrangement is provided, for use in association with the above described wire base structure. The pusher element advantageously is a single piece of plastic sheet material such as rigid vinyl, consisting of front and back panels joined integrally at a top fold, typically in a generally inverted "V" configuration, with a front panel advantageously disposed generally vertically or with a forward lean and the back panel preferably extending downward and rearward at a shallow angle relative to the front panel. The panels are formed with laterally opening notches at each side, adjacent their bottom edges, of a suitable size to loosely receive the outermost ones of the four spaced apart wire elements. The pusher panels are also provided with downwardly opening notches along their bottom edges, positioned to loosely receive the inner pair of the spaced apart wire elements. The wire support elements thus both guide and support the pusher element. To particular advantage, the wire supports, typically formed of steel wire, are painted, to provide a smooth, low friction contact with the plastic panels, enabling them to slide freely in forward and rearward directions along the support wires.

The diameter of the longitudinally extending support wires is such as to provide adequate stiffness of the base when supported exclusively at its front and back end extremities. This will of course be a function of the overall length of the rack and the size and weight of the product items to be supported thereon. In all cases, the entire length of the base wires, between their front and back extremities, is unsupported, such that the pusher element may move freely back and forth over the longitudinal support wires without interference.

In a preferred embodiment of the invention, one or more thin, coiled strip springs are positioned and confined between the front and back pusher panels, with each spring exiting through a confining opening in the front panel. The forward end of each spring is anchored at the front of the display rack such that the pusher element is constantly urged in a forward direction. No special housings or containments are required for the springs, which are allowed to float freely between the front and back panels of the pusher. The number of springs employed depend upon the weight and character of the product being displayed. In the illustrated and particularly advantageous form of the invention, the pusher is provided with three openings in the front panel to accommodate up to three pusher springs. In a typical case, only one spring is utilized, and it exits through the center front opening in the pusher sled. For somewhat heavier display items, two springs may be desired, and these would be aligned with and exit from the opposite side openings in the front panel of the pusher. For still heavier display products, three springs may be employed, one associated with each of the three panel openings.

To particular advantage, the display rack of the invention is comprised of four spaced apart, parallel wire support elements extending in the front to back direction and connected together only at their front and back end portions, typically by being welded to cross bar elements at the front and back. The four-wire support structure is uniquely advantageous in the described combination, providing a stable sliding support for displayed product items (including soft packaged items) and also providing reliable support and guidance for the described form of pusher sled. The described arrangement provides for display racks which can be produced on a highly economical basis for various sizes and types of display products. Additionally and of practical significance, the display rack of the invention enables rapid and inexpensive one-off test mock-ups to be constructed, customized to the requirements of a particular customer. This enables a display rack to be tested in the customer's environment, with respect to the particular product or products proposed to be displayed by the customer. Moreover, test racks may be furnished to a prospective customer on a highly expedited basis, as compared to devices of more conventional construction, enabling customer testing and subsequent full-scale implementation to be achieved in the shortest practicable time.

A particularly advantageous feature of the invention resides in the fact that a plurality of individual product display units may be assembled to provide a multi-unit structure consisting not only of side by side displays, but also multiple levels, one over the other. For example, a convenient counter display rack according to this feature of the invention may combine a plurality of individual display racks to display a variety of similar products, for example various brands of cigarettes, both on a side by side and multi-level basis for convenient selection by the consumer.

For a more complete understanding of the above and other features and advantages of the invention, reference should be made to the following detailed description of preferred embodiments, and to the accompanying drawings.

DESCRIPTION OF THE DRAWINGS

FIGS. 6 and 7 are top plan and bottom plan views respectively of a plastic base member utilized to advantage in the display rack structure of FIG. 1.

DESCRIPTION OF PREFERRED EMBODIMENTS

Figure 1:
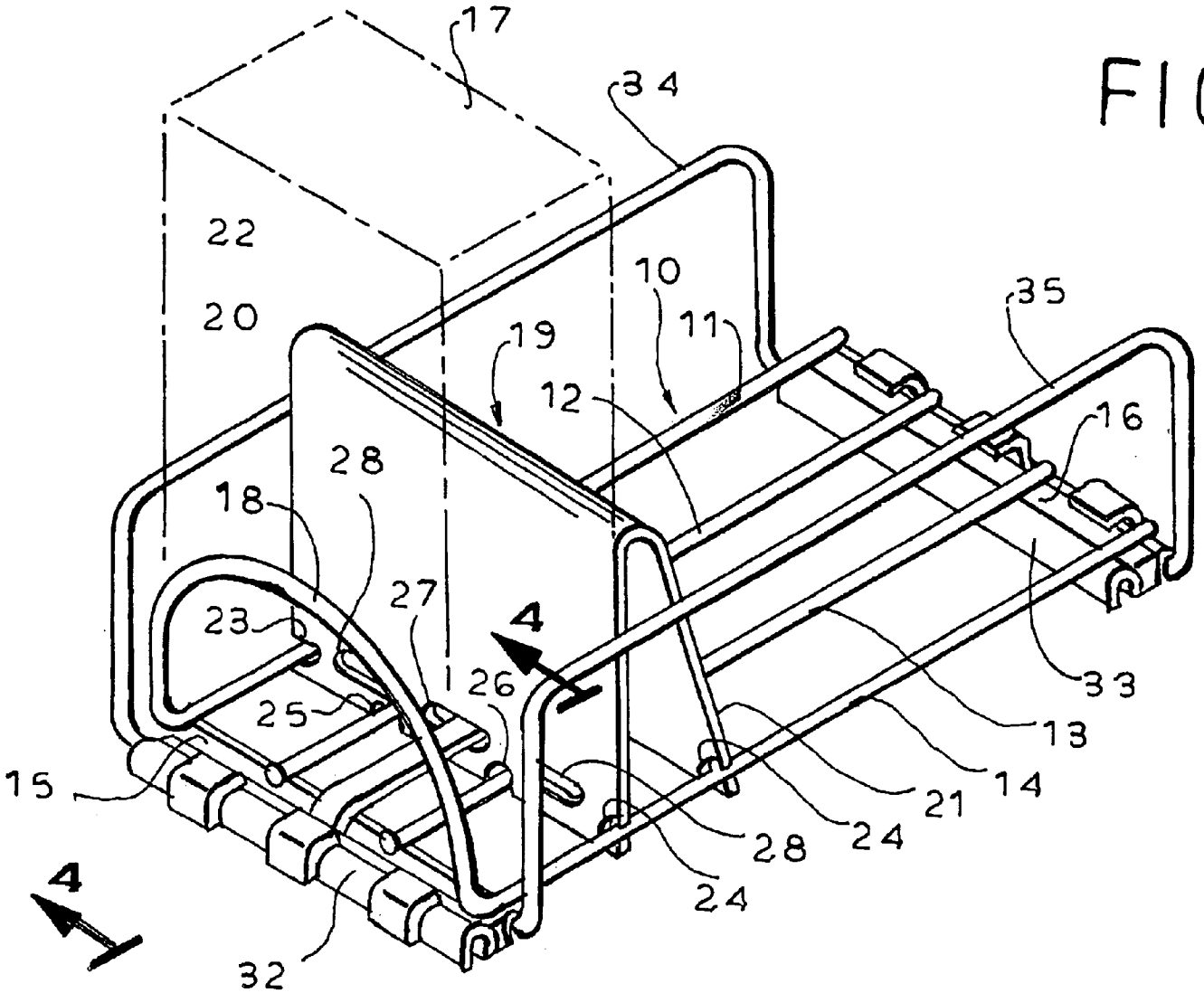
FIG. 1 is a perspective view of a of a display rack according to the invention.
Figure 2:
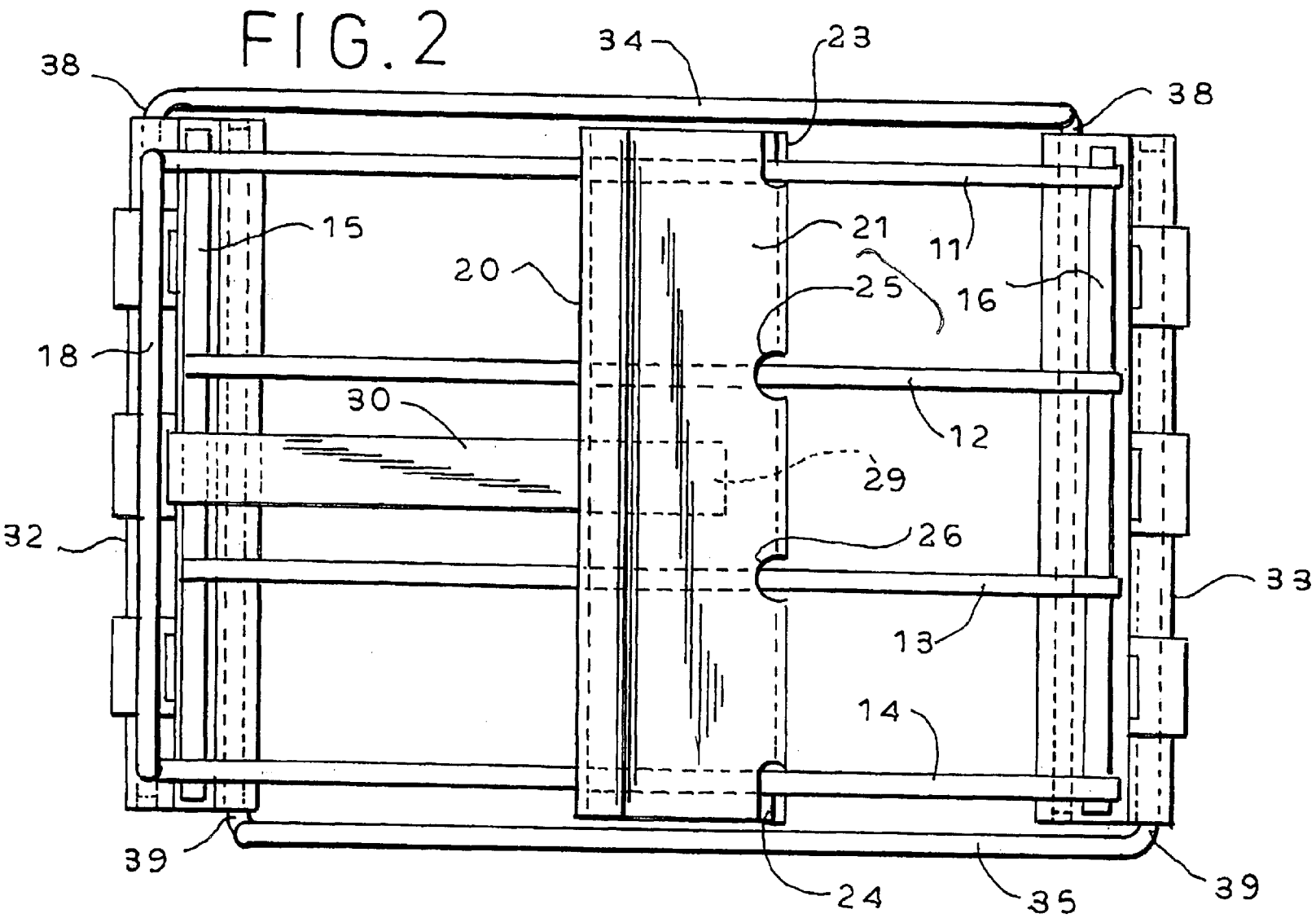
FIG. 2 is a top plan view of the display rack of FIG. 1.

Referring now to the drawings, and initially to FIGS. 1–7, the display rack of the invention comprises a base 10 preferably constructed of four spaced apart, longitudinally extending wire-like supports 11–14. These wire-like supports are connected at their front and back extremities by cross bar elements 15, 16, preferably in the form of wire sections positioned underneath the support wires 11–14 and secured thereto by welding. The four wire-like supports thus are supported in a common plane and provide support for merchandise packages 17, illustrated in FIG. 1. The four support wires preferably are more or less evenly spaced, defining, in the illustrated example, three spaces extending from the front to the back of the display. Steel wire of about 3/16th inch of diameter is suitable for a wide variety of display rack arrangements according to the invention, although in some cases, smaller or larger diameter wires may be preferable.

The display rack advantageously is formed with a front stop 18 extending upwardly from the plane of the support wires 11–14 and serving as a limit stop for product items 17 supported on the rack. In the illustrated form of the invention, the front stop 18 is integrally joined with the outer support wires 11, 14, as reflected in FIG. 1, for example.

The display rack 10 is provided with a special form of pusher sled 19, which is comprised of a single section of rigid vinyl material, preferably extruded as a continuous section and cut to length. The pusher sled illustrated in FIGS. 1–5 includes a flat front panel 20 preferably generally vertically disposed or forwardly tilted, and a similar, generally flat back panel 21, which is joined at its upper edge with the front panel along a rounded fold 22 and preferably extends downward at a slight angle (for example 15 degrees) to the plane of the front wall 20. The pusher sled 19 extends across the full width of the display rack, and the respective panels thereof include both laterally opening notches 23, 24, and downwardly opening notches 25, 26. The laterally opening notches 23, 24 are horizontally disposed and have a height slightly greater than the diameter of the outside wires 11, 14, so as to be received over the wires for easy sliding movement of the sled in forward and rearward directions.

The downwardly opening notches 25, 26 loosely receive the internal support wires 12, 13 to accommodate easy forward and rearward sliding movement of the sled, with the sled being supported primarily by the laterally opening notches 23, 24. The downwardly opening notches 25, 26 advantageously are large enough to provide a clearance space above the internal wires 12, 13. However, the space between inside edges of the vertical notches 25, 26 beneficially can be such that, when the sled is aligned perpendicularly across the display rack 10, the inside edges of the vertical notches 25, 26 are close to the inside surfaces of the wires 12, 13, in order to insure proper lateral alignment of the sled 19 relative to the wires 11–14 during forward and rearward movements of the sled.

Figure 3:
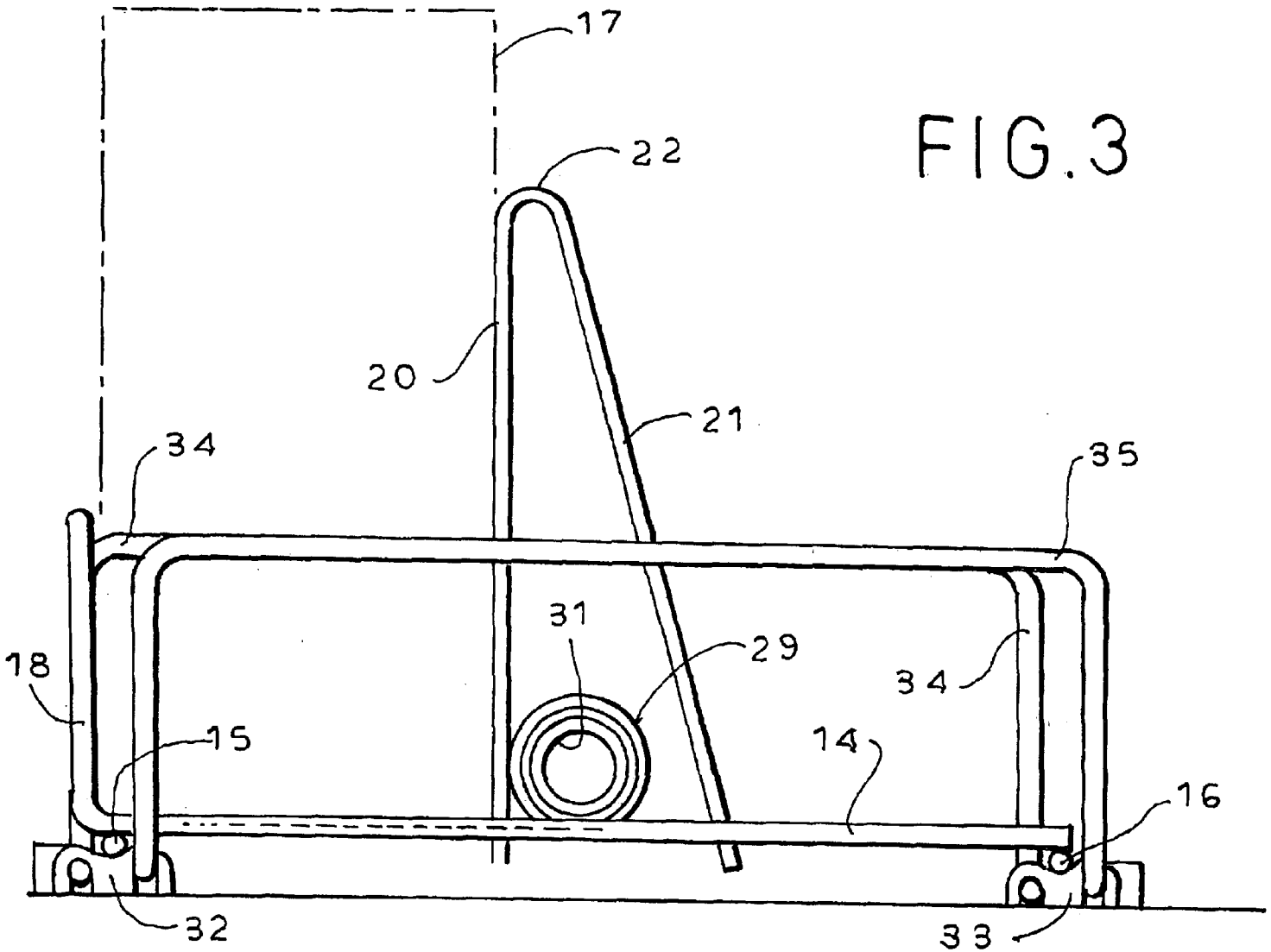
FIG. 3 is a side elevational view of the display rack of FIG. 1.

The sled 19 preferably is produced by continuous extrusion of rigid vinyl material, in a cross sectional configuration generally as shown in, for example, FIG. 3, with a generally uniform material thickness of approximately 1/16th of an inch. As the material exits the extrusion operation, it can be cut to desired lengths, which may vary according to the particular size and shape of the display rack, as will be understood. In conjunction with the cutting to length of the individual sleds, they preferably will be processed at the same time to form the several laterally opening side notches 23, 24 and downwardly opening vertical notches 25, 26. The operations involved are inexpensive and efficient, resulting in a sled which can be produced at far less cost than by the more typical production processes involving injection molding, for example.

At the same time that the several notches 23–26 are being formed in the sled, the front panel 20 of the sled is also being provided with one or a plurality of short, horizontal slots 27, 28. In the illustrated form of the invention, the slot 27 is formed in the center of the front panel 20, while two additional slots 28 are formed, one on either side of the center slot 27, generally aligned with the spaces between the pairs of longitudinal wires 11, 12 and 13, 14. The slots 27, 28 serve to position and confine a coiled strip pusher spring 29, as will be more fully described.

In order to install the sled 19 onto the display rack 10, the front and back panels 20, 21 are squeezed closely together along their bottom edges until the bottom edges are substantially in contact. The thus compressed panels are then disposed at an angle to the perpendicular, with respect to the support wires 11–14 of the rack, and the panels may also be distorted slightly if necessary, to enable the laterally opening notches 23, 24 to be received over the outer support wires 11, 14. In this respect, the respective front and back sled panels 20, 21 are slightly wider than the width of the display rack, as defined by the outside support wires 11, 14, such that the compressed sled panels must be disposed at an angle and/or distorted in order to fit in the space between the outside wires 11, 14. Once the laterally opening notches 23, 24 are aligned with the outside wires 11, 14, the panels may be rotated to a perpendicular orientation, across the width of the display rack, and they may be released from a compressed condition and allowed to assume a normal configuration as shown in FIGS. 1 and 3, for example, with the panel bottom edges spaced apart. The width of the downwardly opening notches 25, 26 is sufficiently greater than the diameter of the inner support wires 12, 13 to accommodate the described angular orientation of the sled panels 20, 21 during the installation operations. Additionally, portions of the support wires 11–14 can be laterally displaced slightly during the sled installation procedure, to allow the parts to be assembled.

Once the sled 19 is properly positioned on the support wires, it is vertically supported by the two outside wires 11, 14 and laterally guided by the two inside wires 12, 13.

To advantage, the laterally opening notches 23, 24 are formed with somewhat of a keyhole configuration, with relatively narrower outer portions, and relatively wider inner portions. The narrower portions preferably are slightly less in width than the diameter of the outermost support wires 11, 14 to inhibit accidental dislodgment of the sled in a case of mishandling.

The pusher sled 19 is intended to be movable in a substantially friction free manner in forward and rearward directions along the support wires 11–14. The vinyl material itself, of which the sled 19 is formed, has advantageous low friction characteristics. Additionally, we have found it to be very advantageous to provide a smooth, low friction painted coating on the outer surfaces of the support wires 11–14, as this results in a further significant reduction of sliding friction of the sled 19. Advantageously, painting can be performed after construction and assembly of the wire elements of the rack, preferably by an electrostatic powder coating operation, in which the paint is cured and fused under heat immediately following electrostatic powder coating operations.

In the display rack of the invention, the coiled strip spring 29, in itself typical of those used for activating product pusher sleds, is positioned between the front and back panels 20, 21 of the sled 19, but is not otherwise housed or confined. The outer end section 30 of the spring is led outward through the horizontal slot 27 in the front wall panel 20 and extends to the front of the display assembly, where it is anchored in a manner to be described. The uncoiled end portion 30 of the spring is both supported and confined by the edges of the slot 27, which in turn serves to support and position the coiled body 31 of the spring. No additional confinement for the spring 29 is required. The natural tendency for the spring 29 to recoil itself, causes the spring to press forwardly against the inside surface of the front panel 20, constantly urging the sled 19 in a forward direction to move the packages 17 to the front of the display, up against the front stop 18. As the sled 19 moves forward and rearward on the wire supports 11, 14, the spring 29 simply uncoils or recoils, depending upon the direction of movement.

In the embodiment of the invention, shown in FIGS. 1–5, the display rack 10 is designed to be able to be supported on a shelf, if desired. Special plastic base members 32, 33 at the front and back attach to the front and back cross bars 15, 16 and support the display rack a short distance above a shelf or other support surface upon which the base members are resting, in order to allow the pusher sled 19 to move freely over the top of the surface. An advantageous function of the base members 32, 33, which is described more fully in co-pending applications Ser. No. 10/024,153 and Ser. No. 10/219,800, is to mount adjustable side guides 34, 35. The side guides, and the features of the base members 32, 33 which accommodate them, are conveniently utilized where lateral confinement of the product is important. Additionally, as will be described further, certain of the side guides 34, 35 may be replaced by elements which connect and/or support other display racks to provide connected arrays of such racks.

The base members 32, 33 typically will be of identical construction, preferably injection molded using an engineering plastic material, such as Celcon®, an acetal copolymer marketed by Celanese Corporation. As indicated in FIGS. 6 and 7, the base members include first and second downwardly opening transverse recesses 36, 37 for the slidable reception of transversely extending portions 38, 39 of the respective side guides 34, 35. The transverse elements 38, 39 are snugly received in the recesses 36, 37 to accommodate intentional transverse adjustment thereof while effectively retaining the side guides in their adjusted positions during normal use.

By inserting the respective side guides 34, 35 in separate recesses 36, 37 in the base members, the respective side guides are offset slightly, which provides for a maximum degree of width adjustability, in that the transversely extending portions 38, 39 may be generally of same length as the plastic base members. In some cases, however, it may be desirable to install a display rack in a pre-assembled wire rack (not shown) having front and back support wires (not shown). In such a case, the transverse portions 38, 39 may be shortened to one half the length of the base members, with both transverse portions being installed in the same recess. This leaves the second recess of each base member open, and allows the base member to be installed in the wire rack by being snapped over the support wires, which are received laterally into the open recesses.

An upwardly opening recess 40 is provided in the base member to receive the cross bar elements 15 or 16. The entrance opening into the recess 40 is restricted by flexible tabs 41 to be slightly less than the diameter of the cross bar elements 15, 16, enabling the elements to be inserted into the recesses 40 by a snap-in action and retained therein until intentionally separated.

As shown in FIGS. 6 and 7, the base members 32, 33 are formed with one or more hollow enclosures 42. Preferably, there are as many of the hollow enclosures 42 as there are slotted openings 27, 28 in the pusher sled 19, with the enclosure 42 being generally aligned with such slotted openings, as reflected in FIG. 2. The assembly thus can accommodate up to three pusher springs 29, if deemed necessary.

Figure 4:
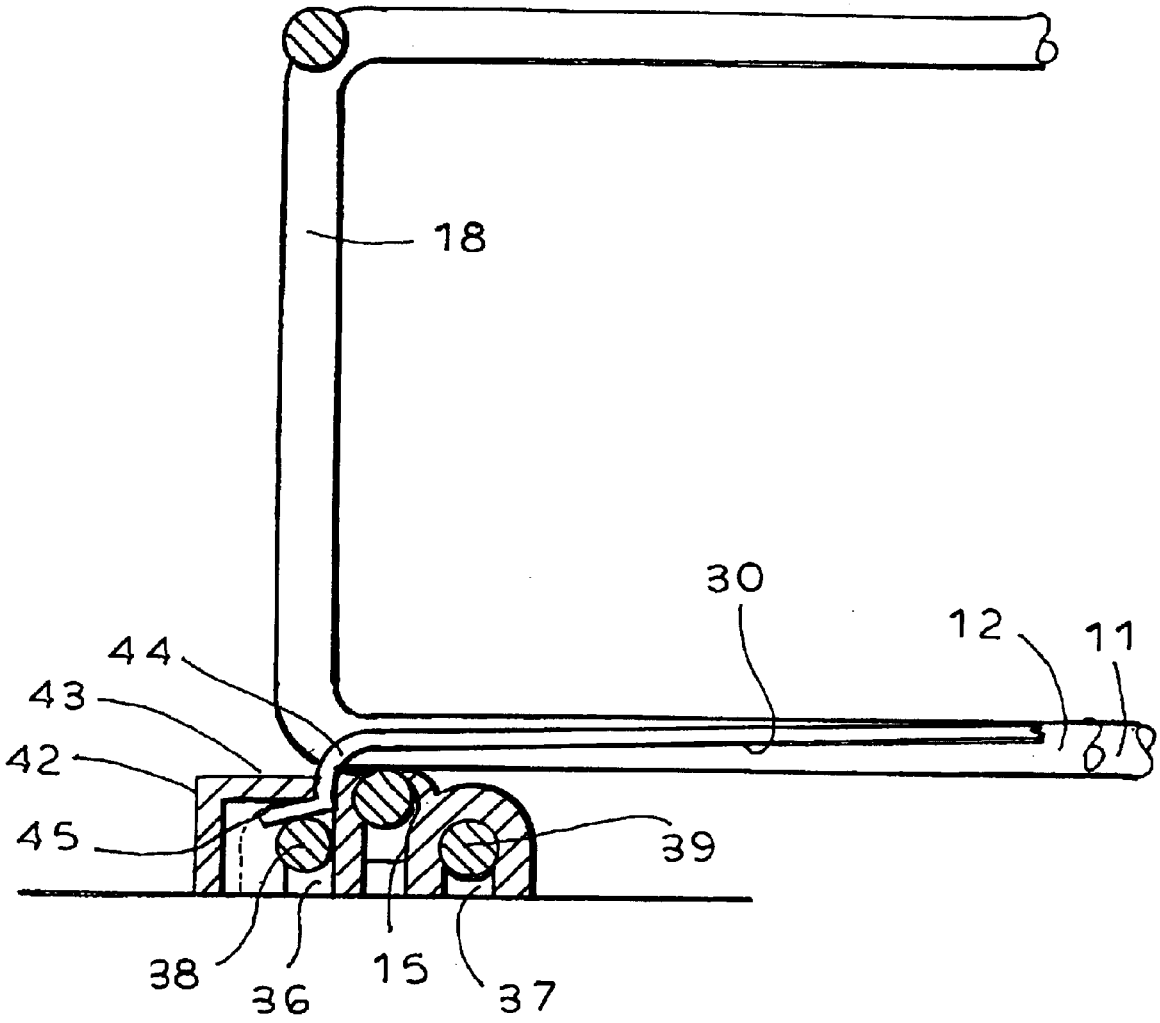
FIG. 4 is an enlarged, fragmentary cross sectional view as taken generally on line 4—4 of FIG. 1.
Figure 5:
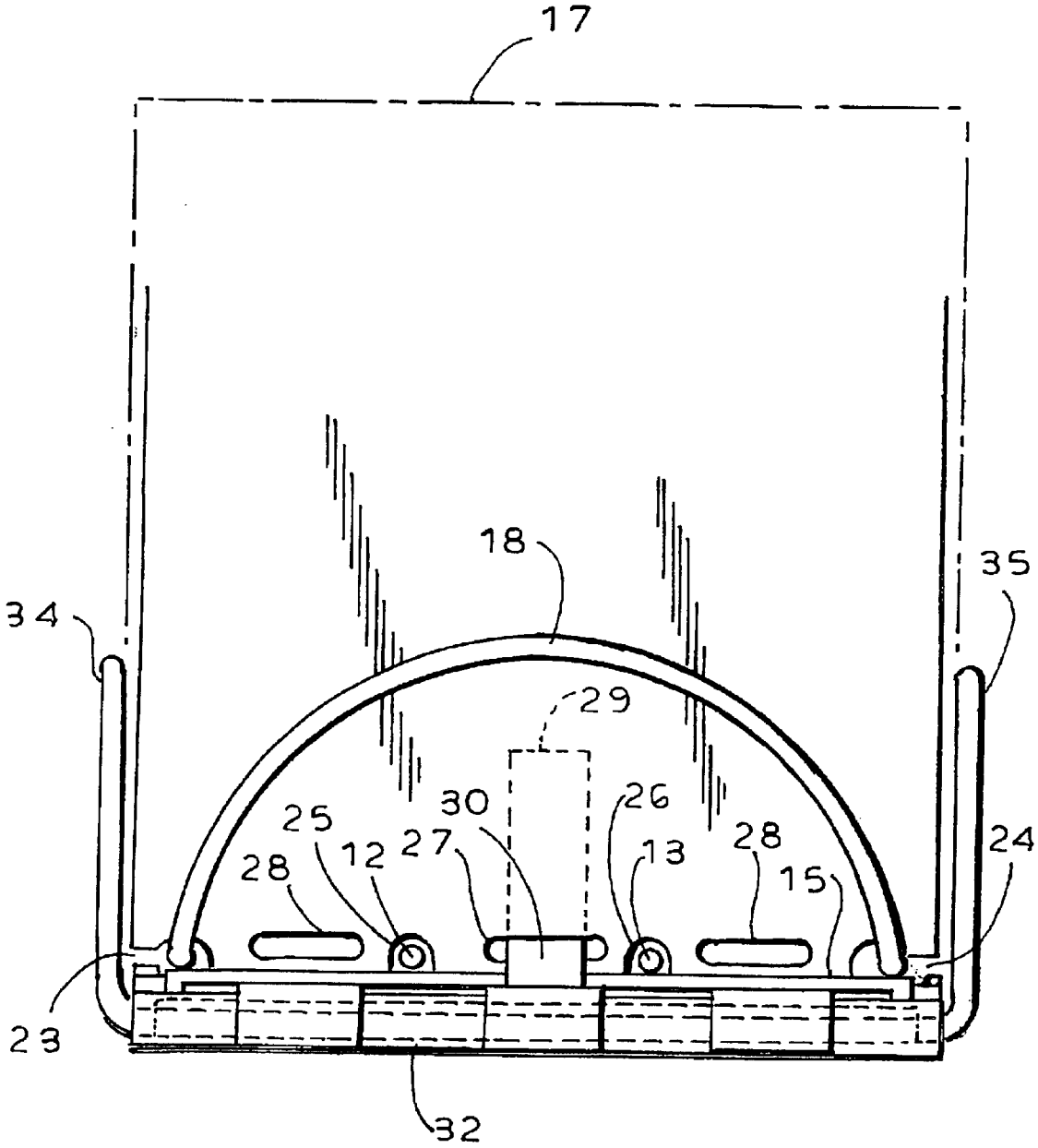
FIG. 5 is a front elevational view of the display rack of FIG. 1.

As shown particularly in FIG. 4, the forward extremity of the spring section 30 is permanently bent to provide first and second offset portions 44, 45. The first portion 44 extends generally downward, and the second offset portion 45 extends forward, generally parallel to the main portion of the spring section 30, as indicated in FIG. 4. As shown in FIGS. 4 and 6, the enclosures 42 are formed with an entrance slot 43 for the reception of offset portions 44, 45 of the spring section 30. In order to insert the offset portions 44, 45 into the slot 43, the adjustable side guide 34 is withdrawn sufficiently to clear its transverse portion 38 to a position away from the slot 43. The offset portions 44, 45 may then be inserted into the slot and allowed to assume a normal position, with the offset portion 45 disposed in the space above the transverse rod portion 38, as reflected in FIG. 4. Once the spring end is installed, the normal forces applied thereto, which are directed generally horizontally, will not cause the spring ends 44, 45 to be withdrawn from the slot 43.

Figure 9:
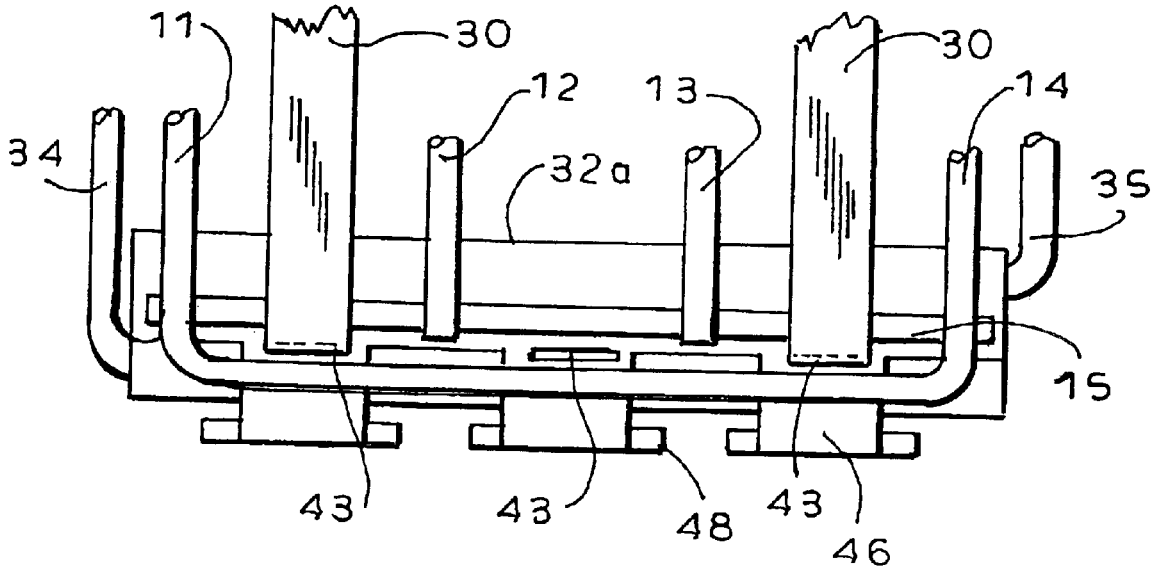
FIG. 9 is a fragmentary top plan view of a modified form of display rack utilizing the base member of FIG. 8 and utilizing a pair of pusher spring elements.

In the illustrated form of the invention, multiple pusher springs 29 may be employed if desired, to provide an additional pushing force for handling of products of greater weight. For example, in the specific embodiment illustrated in FIGS. 1–5, any combination of one, two or three springs may be employed. The use of a single spring is specifically illustrated in FIGS. 1–5. If two springs were desired, they can be installed and confined between the front and back pusher walls, substantially as indicated in FIG. 3, with forwardly extending portions 30 of the springs passing through the outboard slots 28 and anchored forwardly in the base member 32*a* (FIG. 9), by means of anchor slots 43. If a third spring were desired, the central spring, shown in FIGS. 1–5, would be retained, along with two additional springs extended through the outboard openings 28. Pursuant to the invention, the use of multiple pusher springs requires no additional complicated moldings or the like, and springs can be installed and removed easily by store personnel. This provides for a high degree of flexibility in the setup of the display assembly, without any significant additional cost.

A particular advantage of the illustrated base structure of the display rack, comprising four spaced apart wire support elements 11–14, is that, in addition to being lightweight, easily and inexpensively manufactured, it provides excellent low-friction support for a wide variety of products, including soft packages. Additionally, the four spaced apart support wires serve highly effective guidance and support functions for the pusher sled 19, with the inner supports 12, 13 providing lateral guidance and the outer supports 11, 14 providing vertical support and engagement of the sled. The configuration of four spaced apart wires also provides for three open spaces for receiving one, two, or three pusher springs. In this respect, it is desirable that the forwardly extending portions 30 of the pusher springs extend underneath the packages supported on the wire elements 11–14, preferably without engaging them, and at least without tending to lift them. The spring confining slots 27, 28 in the front panel of the pusher thus are located at a level that allows the forwardly extending spring portions 30 to exit below the top surfaces of the support wires 11–14 and to extend between adjacent pairs of wires forwardly to their respective anchor points.

Figure 8:
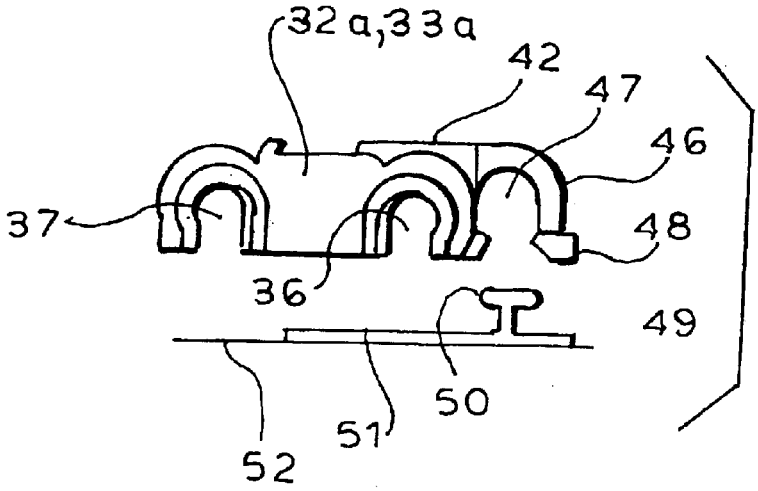
FIG. 8 is an exploded view, illustrating a modified form of plastic base member provided with means for engagement with a guide track.

In some advantageous forms of the display rack, it may be desired to locate the display rack in an orderly fashion on the surface of a shelf or other support. For this purpose, the base members 32, 33 may be modified in the manner shown in FIGS. 8 and 9. In this modification, tongue-like extensions 46 extend outward and downward from the housings 42 to form an inverted U-shaped recess 47. At the lower end of each of the tongue-like extensions is a horizontal guide bar 48, which preferably is of somewhat greater length than the width of the extension 46. A portion of the guide bar 48 extends into the U-shaped recess 47 and is opposed by a rib 49 on the opposite side of the recess, which also projects somewhat into the recess to form a restricted entrance. The lower surfaces of the guide bar 48 and rib 49 are outwardly divergent to facilitate a snap-on attachment of the base member 32*a*, 33*a* to a T-shaped guide rail 50 projecting upwardly from a guide strip 51. The guide strip is fastened by adhesive or other means to a display surface 52 (FIG. 8). When a base member is snapped over the guide rail it becomes locked thereto, while being slidable lengthwise along the guide rail. Typically, the guide strip 51 is mounted near the front of a display shelf or the like, such that one or more display racks, mounted on bases 32*a*, 33*a*, can be positioned in accurate front to back alignment by the guide strip 51 and guide rail 50.

For certain applications, such as freezers, spaced apart wires or rails (not shown) are provided in positions to be received in the downwardly opening U-shaped recesses 47 at the front and back of a display rack assembly. A thus mounted display rack is movable laterally along the wire or rail supports to provide access to areas below.

Figure 10:
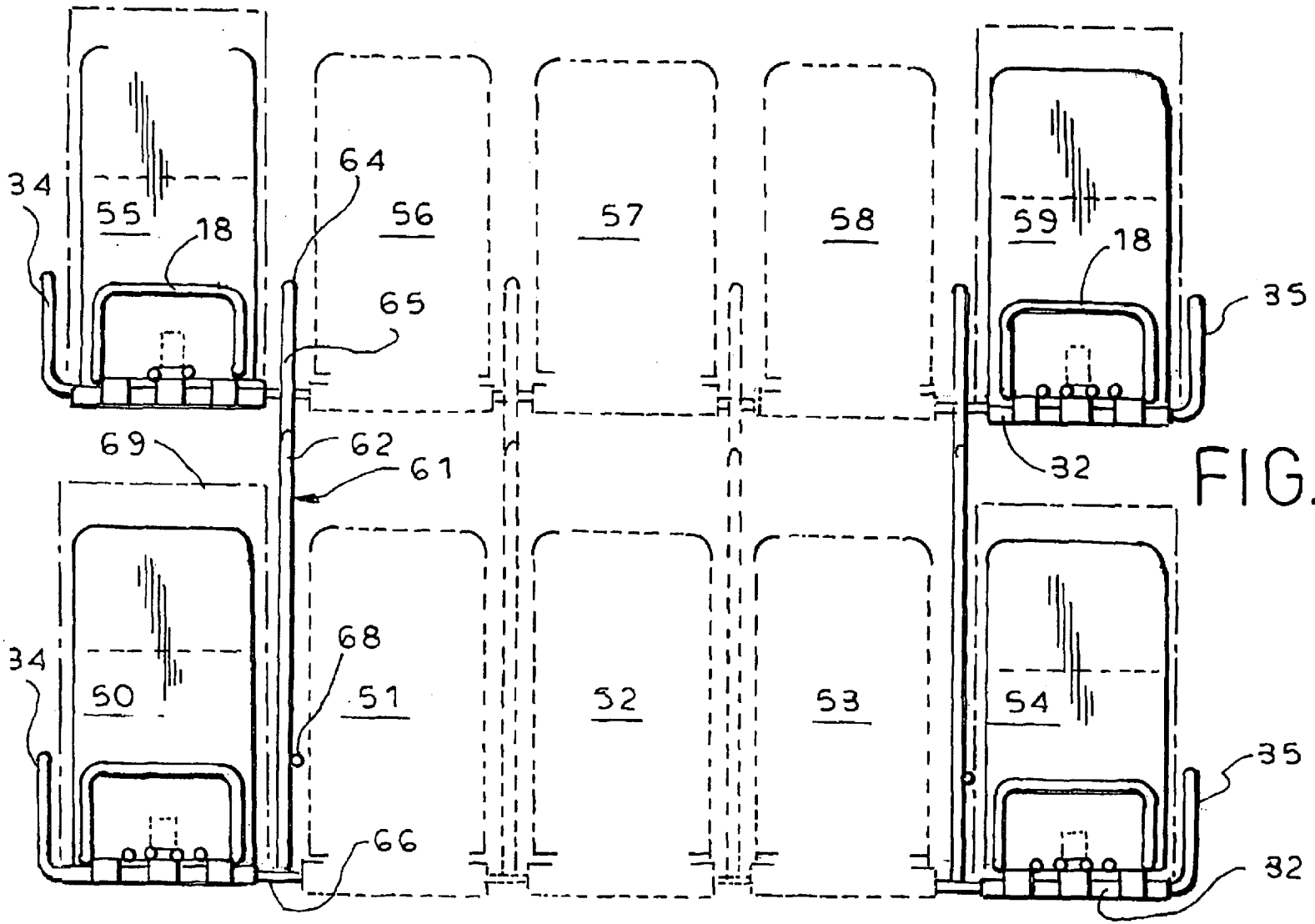
FIG. 10 is a front elevational view of an embodiment of the invention in which display racks are arranged in a multiple of side by side units and on multiple levels.

Referring now to FIGS. 10–13, there is shown an embodiment of the invention in which the display rack is joined with other similar racks in a novel and advantageous manner to provide a multiple rack structure, with racks positioned in a side by side arrangement and also in a multi-level arrangement. With reference to FIG. 10, there is shown a multi-unit rack structure comprising a plurality of laterally adjacent display racks 50–54 on a lower tier, and a second plurality of laterally adjacent display racks 55–59 on an upper tier. The individual display racks advantageously are constructed in the manner previously described herein.

As will be noted in FIG. 10, only the endmost display racks 50, 54 and 55, 59 are provided with the regular form of side guide elements 34 or 35.

Figure 13:
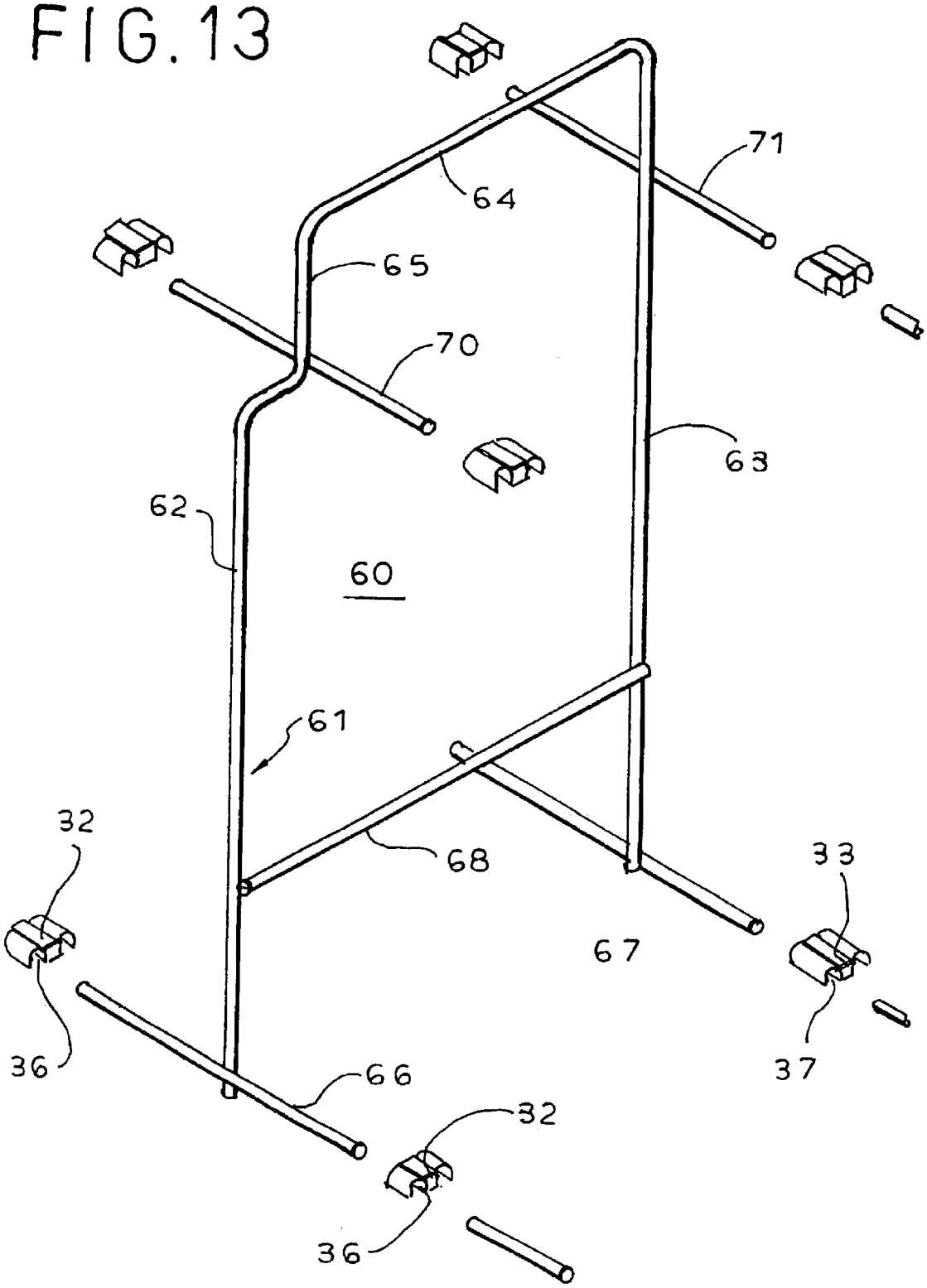
FIG. 13 is an exploded view of the structure of FIG. 10 illustrating the manner in which multiple rack units are joined side by side and one above the other.

Between each adjacent pair of display racks in the structure of FIG. 10 is a connecting frame 60, illustrated particularly in FIG. 13. The connecting frame includes a primary frame element 61 of generally inverted U-shaped configuration, including front and rear vertical supports 62, 63, and an upper, generally horizontal connecting portion 64. Preferably, an upper portion 65 of the front support element 62 is offset toward the rear, for purposes to be described.

Adjacent the lower ends of the vertical supports 62, 63 horizontal connecting bars 66, 67 are secured by welding, and these are disposed perpendicular to the plane of the connecting frame 60, as is evident in FIG. 13. The connecting bars 66, 67 are adapted to be received in the recesses 36, 37 of respective front and back plastic base elements 32, 33 of laterally adjacent, lower tier display racks. These display racks are thus physically connected together in aligned, side by side relation. The spacing between adjacent racks can be adjusted, within practical limits, by adjustment of the degree of insertion of the connecting rods 66, 67 into the respective plastic bases of adjacent display racks.

As reflected in FIG. 10, a longitudinally extending rod 68 connects lower portions of the vertical supports 62, 63. Desirably, the height of the connecting rod 68 corresponds to the height of the side guides 34, 35, and the connecting rods in fact serve in the capacity of side guides to confine the product items 69 on their respective display racks.

Pursuant to the invention, a pair of upper connecting bars 70, 71 is provided for support and engagement of laterally adjacent pairs of upper tier display racks 55–59. The respective connecting bars 70, 71 are secured by welding to the vertical supports 62, 63 and, like the lower connecting bars 66, 67, extend perpendicular to the plane of the frame 61. To advantage, the upper forward connecting bar 70 is connected to the inwardly offset portion 65 of the front support 62. Accordingly, the upper tier of display racks 55–59 is preferably shorter than the racks of the lower tier by the amount of the offset.

As is evident in FIG. 10, for example, the entire upper tier of display racks 55–59 is supported exclusively by the series of support frames 60, of which there may be one or more, depending upon the number of laterally adjacent display racks. The outermost upper tier display racks 55, 59 are supported by a single pair of connecting bars 70, 71, while the interior racks 56–58 are supported by an adjacent pair of connecting bars, one from each side.

Figure 11:
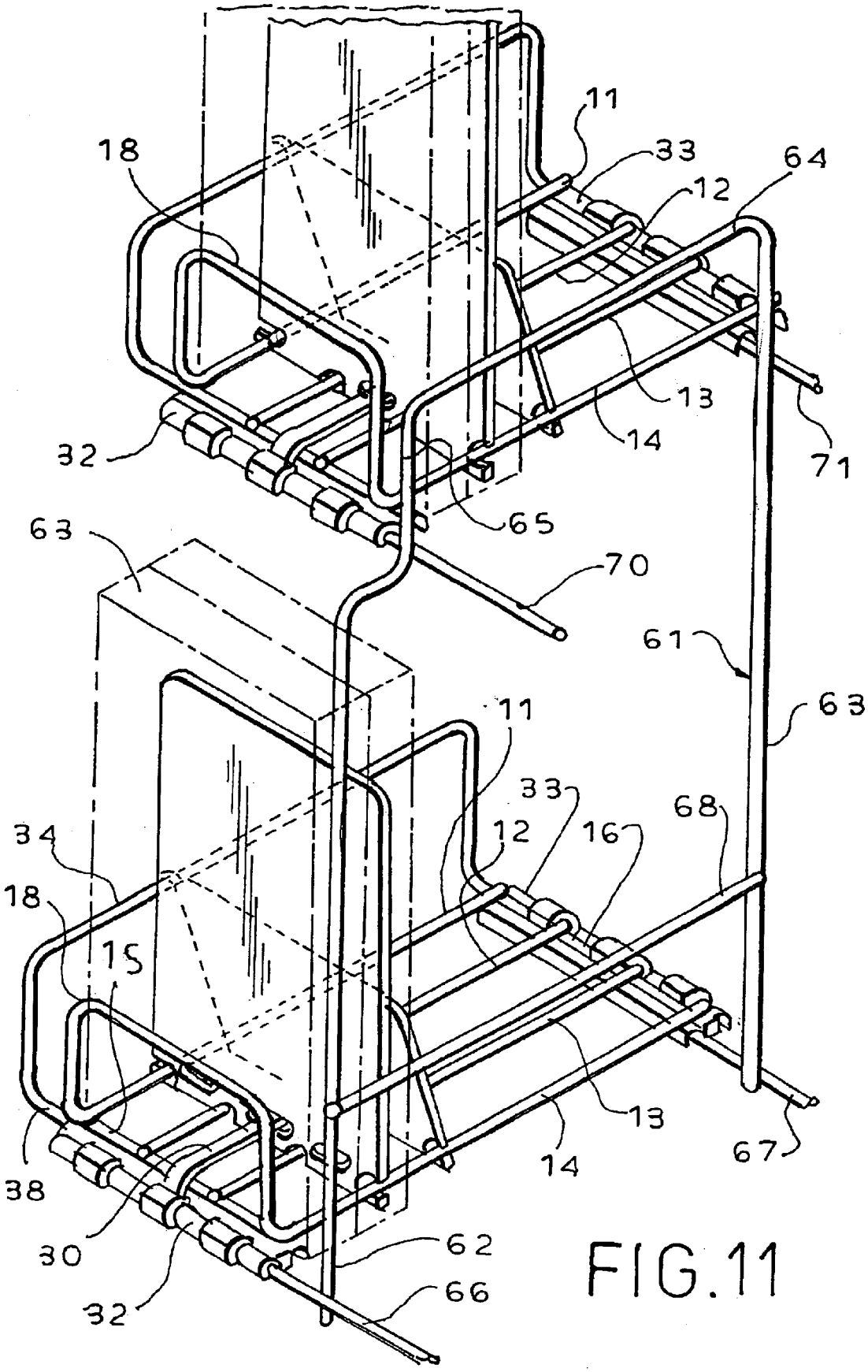
FIG. 11 is a perspective view of a portion of the structure of FIG. 10.
Figure 12:
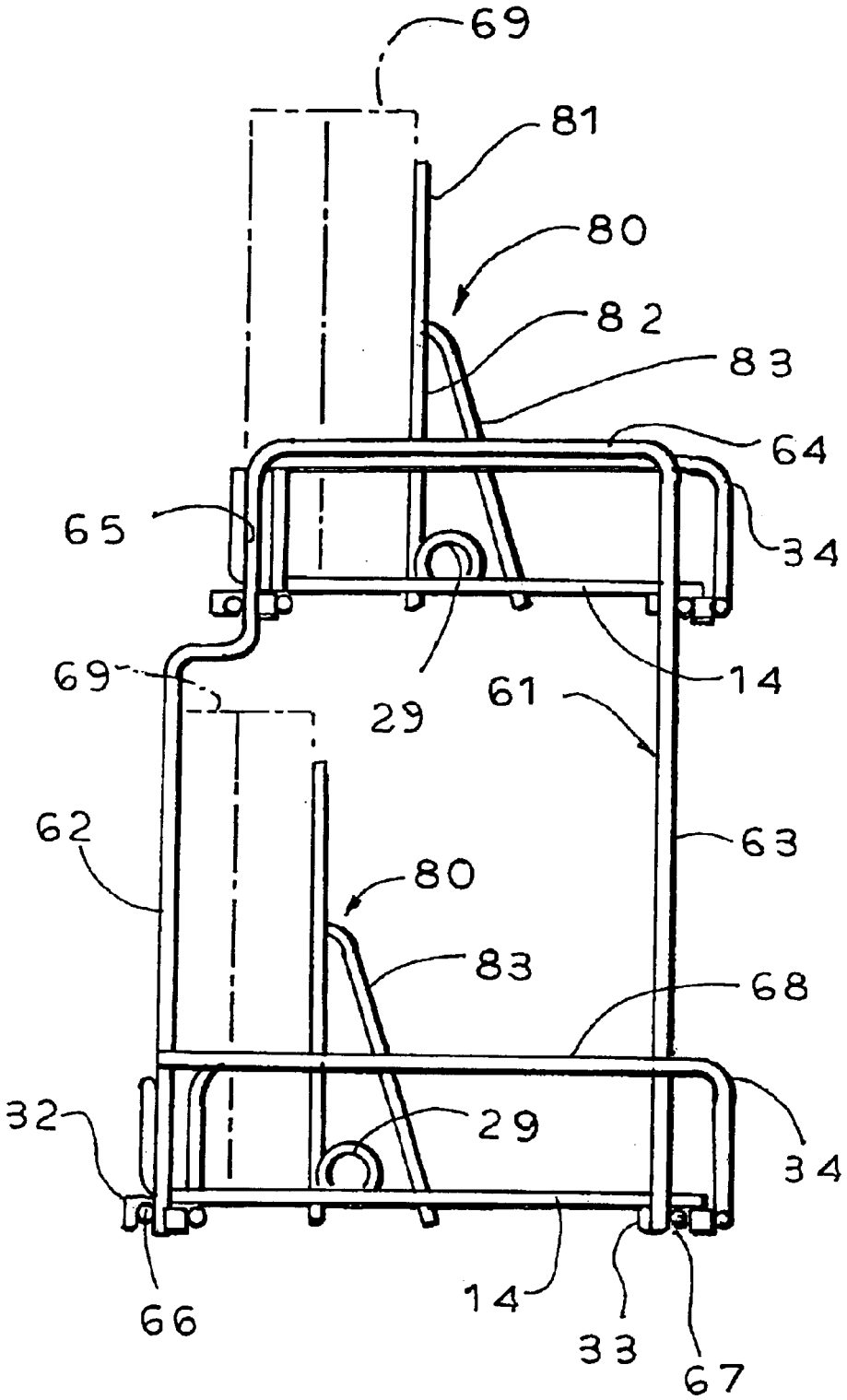
FIG. 12 is an end elevational view of the partial structure of FIG. 10.

As is evident in FIGS. 11 and 12, mounting of the upper tier display racks along the offset portions 65 of the front supports serves to offset the upper display racks rearwardly somewhat from the lower tier display racks. This provides for easy access to product items 69 positioned in the forwardmost display positions on the lower tier racks.

For the upper tier display racks 55–59, the upper connecting portion 64 of each of the frames 61 serves in the capacity of a side guide between an adjacent pair of display racks for lateral confinement of the display products. Accordingly, the vertical distance between the upper connecting rods 70, 71 and the frame portion 64 corresponds generally to the height of the respective side guides 34, 35.

As will be understood, it would be within the principles of the invention to provide for more than two tiers of display racks under appropriate circumstances. In such a case, each upper tier preferably will be offset slightly to the rear of the tier immediately below.

The multi-tier connecting frame structure 60 shown in FIG. 13 adds enormously to the versatility of the illustrated display racks, in that it enables easy customized configuration and reconfiguration of multiple display racks by store owners. It is very easy and efficient to assemble a multi-unit, multi-tier rack structure in the first instance, and to reorganize that structure later on by adding or removing units. Although typically, all of the display racks in a multi-unit structure will be of the same size, it is only necessary that racks of the upper tier be of the same size width as the rack or racks immediately below.

The structure of FIGS. 10–13 illustrates a slightly modified form of pusher sled 80. In general principle, the pusher sled 80 is the same as the sled 19 shown in FIG. 1, for example. However, it includes an integral upward extension 81 of the main panel 82. The rear panel 83 is joined integrally and flexibly to the panel 82 and its extension 81. The configuration of the lower end of the panels 82, 83 is the same as that of the sled 19 of FIG. 1, to accommodate reception of the four-wire base structure as previously described. To advantage, the pusher sled 80 is produced by continuous extrusion, with the individual units being cut to desired width and the notches and openings formed therein as part of a continuous production procedure.

In its most advantageous configuration, the display rack of the invention comprises a base structure of four longitudinally extending, spaced apart wire-like support elements, rigidly connected at their front and back ends. This base structure is combined with a highly advantageous form of pusher sled, which is provided with spaced apart, downwardly opening slots for the reception of the inner pair of support wires, and with laterally opening slots for engagement of and support by the outermost pair of support wires. This is an exceptionally simplified display rack structure, which provides for free movement of the pusher sled, while reliably positioning and retaining the pusher sled in normal operations. At the same time, the arrangement accommodates easy assembly of the sled to the wire support base by squeezing together front and back panels of the sled, disposing the sled at a slight angle to the perpendicular relative to the base wires, applying the sled first downwardly over the inner pair of support wires and then twisting it or allowing it to twist back to a perpendicular orientation to engage the laterally opening slots with the outermost support wires. A lesser number of support wires forming the base structure is less than satisfactory. The use of only a single pair of wires, for example engaging the laterally opening slots, could enable the sled to be easily dislodged from its supported position if accidentally mishandled. The dislodgment of a sled from its wire supports would be an inconvenience at best, and could be a hazard if under spring tension. The use of four wires for supporting a sled allows two of the wires to engage center portions of the sled for lateral guidance, making accidental dislodgment of the sled extremely difficult. Additionally, by configuring the laterally opening slots to have a keyhole shape, with a restricted entrance/exit opening, the likelihood of accidentally dislodging a sled becomes negligible. Constructing the base of three longitudinal wires makes placement of the spring and/or immediate wire difficult, as there will be asymmetrical pulling forces, or frictional resistance, or both. The use of four spaced apart wires for the base structure, on the other hand, accommodates the presence of one, two or three pusher springs, and also provides a support structure which is suitable for almost any kind of display product, including soft packages.

Although a four-wire base structure is considered suitable for almost all applications, if greater base support were required for an exceptionally wide product, additional support wires could be provided. In such a case, additional support wires should be provided in pairs, for example, an additional wire on each side. The pusher sled would not necessarily have to be enlarged in such a case, but could be mounted and guided by the innermost four wires.

One of the more unobvious but highly significant advantages of the display rack structure of the present invention resides in the fact that one-off, customized rack structures can be manufactured quickly and inexpensively. Conventional display rack arrangements with provisions for product pushers are relatively complicated in nature and frequently involve the use of specially molded parts. The fabrication of one-off customized test units for customer trials is both time consuming and expensive, where the basic structure involves specially molded parts, because it is necessary either to prepare new molds or to make specially fabricated parts to serve temporarily in lieu of a molded finished part. The display rack of the present invention, in important contrast, can be highly customized by shaping and sizing of a few wire parts. The plastic base members, while being molded parts, are universal, and a few standardized sizes of such base members can be used for both mass production units and one-off customized test samples. Likewise, a few standard sled configurations will suffice for both the mass production units and for customized test samples. Importantly, whereas the preparation of specially molded or specially fabricated parts can involve several weeks time, the preparation of a one-off customized wire base can be prepared in a few hours. Time savings of this type are highly valuable to the store owners, particularly large chains, where a new product and its display must be tested and phased into the marketing system in the shortest practicable time.

The provision of a multi-unit structure, multi-tier display structure, using a standardized design of display rack with applicant's unique form of connecting structure, enables the merchandiser to easily and quickly self-customize multi-unit displays to suit specific requirements.

Display racks incorporating the teachings of the invention need not be mounted or supported on a shelf or similar surface but can be arranged in any suitable way, such as being mounted on an apertured display board as described in co-pending application Ser. No. 10/232,509, for example.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display rack for the display of multiple merchandise packages with provisions for moving product packages toward the front of the assembly as packages are removed by customers, which comprises (a) a support base comprising four spaced-apart, parallel support elements formed of wire and connected together at front and back ends thereof, (b) means for supporting said base at least a short distance above an underlying surface, (c) a product pusher mounted on said support elements for forward and rearward sliding movement, for urging packages to the front of said display assembly, (d) said product pusher comprising a sheet-like structure of plastic material including front and back wall panels joined together and having bottom edge margins spaced apart in the direction of said sliding movement, (e) said front and back wall panels having laterally opening notches therein along opposite edges thereof adjacent said bottom edge margins, slideably engaging outer ones of said wire support elements, and a pair of downwardly opening notches in said bottom edge margins slideably engaging inner ones of said wire support elements, (f) a coiled strip spring for urging said product pushed in a forward direction, (g) means at a forward end of said display rack for securing one end of said spring, (h) spaced apart internal surfaces of said product pusher forming a confinement for a coiled body of said strip spring with said coiled body urging said product pusher in a forward direction, (i) said front wall panel having at least one opening therein positioned centrally therein and between said inner ones of said wire support elements for the passage of said strip spring.

2. A display rack according to claim 1, wherein (a) said laterally opening notches being of generally keyhole configuration, with restricted openings at the side edge extremities of said wall panels.

3. A display rack according to claim 1, wherein (a) said product pusher is assembled to said display rack by temporarily compressing said lower edge margins closely together and temporarily orienting the thus compressed product pusher at an angle of less than 90 degrees with respect to said support elements to enable said laterally opening notches to be engaged with said outer ones of said support elements, while enabling said downwardly opening notches to be engaged with said inner ones of said support elements.

4. A display assembly according to claim 1, wherein (a) said front wall panel is formed with a plurality of laterally spaced, horizontally disposed slots therein for receiving a plurality of strip coil springs, (b) said slots being aligned with spaces between said wire support elements.

5. A display rack for the display of multiple merchandise packages with provisions for moving product packages toward the front of the assembly as packages are removed by customers, which comprises (a) a support base arranged to extend outward in a point of purchase product display, (b) said support base comprising four spaced-apart, parallel wire support elements extending from front to back and rigidly connected together at front and back ends thereof, (c) a product pusher mounted on said display rack for forward and rearward sliding movement thereon, for urging packages to the front of said display assembly, (d) said product pusher comprising an extruded sheet-like structure of plastic material including front and back wall panels joined together and having bottom edge margins normally spaced apart in the direction of said sliding movement, (e) said front and back wall panels having edge opening notches therein slideably engaging each of the four wire support elements of said display rack, (f) at least two of said notches being generally horizontally disposed in regions thereof engaging support elements, (g) a coiled strip spring confined between said panels for urging said product in a forward direction, (h) means at a forward end of said display rack for securing one end of said spring, (i) the front wall panel of said product pusher having an opening with side edges for lateral confinement of said spring, (j) said opening being located between the inner ones of said wire support elements.

6. A display assembly for the display of multiple merchandise packages with provisions for moving product packages toward the front of the assembly as packages are removed by customers, which comprises (a) a display rack comprising four spaced apart, parallel wire-like support elements mounted to extend in a front-to-back direction in a point of purchase product display and positioned in a common plane, (b) a product pusher slideably mounted on said support elements for forward and rearward movements, (c) said product pusher comprising front and back, generally flat panels of plastic material joined together above spaced apart bottom edges thereof, (d) said panels having horizontally disposed notches in opposite side edges thereof for sliding engagement with outer ones of said wire-like support elements and downwardly opening notches in bottom edges thereof for sliding engagement with inner ones of said wire-like support elements, (e) a guide opening in said front panel, and (f) a coiled strip spring having a coiled body positioned between and confined by said front and back panels and having a portion extending forwardly through said guide opening and between said inner ones of said support elements and anchored at a front portion of said display rack for urging said product pusher in a forward direction.

7. A display assembly according to claim 6, wherein (a) said product pusher is formed of plastic material and is formed by extrusion.

8. A display assembly according to claim 6, wherein (a) said panels are sufficiently flexible to enable the lower edges of the front and back panels thereof to be temporarily compressed together for mounting of said product pusher on said display rack.

9. A display assembly according to claim 6, wherein (a) said support rods are covered with a coating of paint to facilitate sliding movement of said product pusher.

10. A multi-unit display rack assembly comprising (a) a plurality of display racks arranged in laterally side-by-side relation in a plurality of tiers, (b) said display racks each including a product support base and front and back plastic base members underlying and engaged with front and back end portions of said support base, (c) said plastic base members including transversely disposed recesses therein opening at the ends of said base members, (d) one or more multi-tier connecting frames disposed between said display racks, (e) said connecting frames numbering one less than the number of display racks, (f) each of said connecting frames including a pair of front and back wire-like connecting elements corresponding to each tier of display racks, (g) said connecting elements being received in and engaged with transversely disposed recesses in said base members for securing together an adjacent pair of display racks, (h) display racks of upper tiers thereof being supported in elevated positions by said connecting elements.

11. A display rack assembly according to claim 10, wherein (a) said connecting frames comprise front and back vertical supports, (b) a first connecting rod extends between said vertical supports and forms a side guide for display racks of a lower tier positioned laterally adjacent thereto, and (c) a second connecting portion extends between upper portions of said vertical supports and forms a side guide for display racks of an uppermost tier positioned laterally adjacent thereto.

12. A display rack assembly according to claim 10 wherein (a) portions of said front vertical support are offset rearwardly at the level of an upper tier of display racks, with respect to portions of said vertical support below said upper tier, and (b) the front and back wire-like connecting elements supporting said upper tier of display racks are fixed to the rearwardly offset portions of said front vertical support, whereby display racks of an upper tier thereof are offset rearwardly of display racks of a tier below.

13. A display rack assembly according to claim 10 wherein (a) said wire-like connecting elements are tightly but movably received within recesses of said base members, whereby the space between laterally adjacent display racks may be adjusted, and whereby said display rack assembly may be expanded or contracted by the addition or removal of display racks.

* * * * *